US010854160B2

(12) United States Patent
Tominaga

(10) Patent No.: US 10,854,160 B2
(45) Date of Patent: Dec. 1, 2020

(54) DISPLAY DEVICE

(71) Applicant: Sharp Kabushiki Kaisha, Sakai (JP)

(72) Inventor: Masakatsu Tominaga, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/540,101

(22) Filed: Aug. 14, 2019

(65) Prior Publication Data

US 2020/0074952 A1 Mar. 5, 2020

Related U.S. Application Data

(60) Provisional application No. 62/724,664, filed on Aug. 30, 2018.

(51) Int. Cl.
*G09G 3/36* (2006.01)

(52) U.S. Cl.
CPC ... *G09G 3/3677* (2013.01); *G09G 2300/0413* (2013.01); *G09G 2310/0202* (2013.01); *G09G 2310/08* (2013.01); *G09G 2320/02* (2013.01); *G09G 2330/021* (2013.01); *G09G 2330/04* (2013.01); *G09G 2330/08* (2013.01)

(58) Field of Classification Search
None
See application file for complete search history.

(56) References Cited

U.S. PATENT DOCUMENTS

2007/0001987 A1* 1/2007 Chun ..... G11C 19/00 345/100
2011/0074743 A1* 3/2011 Son ..... G09G 3/20 345/204

FOREIGN PATENT DOCUMENTS

JP 2013-80041 A 5/2013

* cited by examiner

*Primary Examiner* — Stephen T. Reed
(74) *Attorney, Agent, or Firm* — Keating & Bennett, LLP

(57) ABSTRACT

Regarding any gate clock signal transmission line, assuming that two signal transmission lines that are adjacent to the focused gate clock signal transmission line are defined as a first adjacent signal line and a second adjacent signal line, and that a combination of a potential of the first adjacent signal line and a potential of the second adjacent signal line when a potential of the focused gate clock signal transmission line changes from a high level to a low level is defined as an adjacent signal line state, a plurality of signal transmission lines including the plurality of gate clock signal transmission lines are disposed between the signal input terminal and the gate driver so that the adjacent signal line state for all of the plurality of gate clock signal transmission lines are the same.

7 Claims, 18 Drawing Sheets

DISPLAY DEVICE

CROSS REFERENCE TO RELATED APPLICATIONS

This application claims priority to U.S. Provisional Patent Application No. 62/724,664, entitled "DISPLAY DEVICE", filed on Aug. 30, 2018, the content of which is incorporated herein by reference.

BACKGROUND OF THE INVENTION

1. Field of the Invention

This disclosure relates to a display device having a monolithic gate driver.

2. Description of Related Art

Conventionally, there is known a display device including a display unit having a plurality of source bus lines (video signal lines) and a plurality of gate bus lines (scanning signal lines). Regarding such a display device, conventionally, a gate driver (scanning signal line drive circuit) for driving gate bus lines is often mounted, as an IC (Integrated Circuit) chip, on the periphery of substrates constituting a display panel. However, in recent years, providing a gate driver directly on a substrate that constitutes a display panel has been gradually increasing. Such a gate driver is called a "monolithic gate driver". Taking a liquid crystal display device as an example, a monolithic gate driver is provided on a TFT substrate, which is one of two glass substrates constituting a liquid crystal panel. In the following, the liquid crystal display device will be described as an example.

Typically, a gate control signal that controls an operation of the monolithic gate driver is supplied from outside of the liquid crystal panel constituted by a TFT substrate and a color filter substrate. As shown in FIG. 15, a signal input terminal 71 for receiving gate control signals and the like supplied from outside is provided on one end of the TFT substrate. In the example shown in FIG. 15, a gate control signal including a gate start pulse signal GSP and gate clock signals CK1, CK1B, CK2, and CK2B as four-phase clock signals, and a low-level direct power-supply voltage VSS are supplied to the signal input terminal 71. Regarding FIG. 15, a portion indicated by a reference sign 73 is a region where the TFT substrate and the color filter substrate face each other, and a portion indicated by a reference sign 74 is a region where the color filter substrate is not provided at a position to which the TFT substrate faces. An example of layout of signal transmission lines between the monolithic gate driver and the signal input terminal is disclosed in Japanese Laid-Open Patent Publication No. 2013-80041, for example.

Here, in the following description, it is assumed that a potential of the gate control signal on a high-level side is a gate high potential (a potential for turning pixel TFTs connected to the gate bus lines to an on state), and a potential of the gate control signal on a low-level side is a gate low potential (a potential for turning pixel TFTs connected to the gate bus lines to an off state). It is also assumed that a potential supplied by the low-level direct power-supply voltage VSS is equal to the gate low potential, and a potential supplied by a high-level direct power-supply voltage VDD is equal to the gate high potential.

In the present specification, a line for transmitting various signals or power-supply voltages from one component to another component is referred to as a "signal transmission line". Further, signal lines for transmitting the gate clock signals CK1, CK1B, CK2, and CK2B are referred to as a "CK1 transmission line", a "CK1B transmission line", a "CK2 transmission line", and a "CK2B transmission line", respectively, a signal line for transmitting the gate start pulse signal GSP is referred to as a "GSP transmission line", and a signal line for transmitting the low-level direct power-supply voltage VSS is referred to as a "VSS transmission line". Here, the CK1 transmission line, the CK1B transmission line, the CK2 transmission line, and the CK2B transmission line are collectively referred to as "gate clock signal transmission lines".

Regarding the configuration shown in FIG. 15, a protection circuit 72 for protecting a circuit element within the gate driver from static electricity is provided between the signal input terminal 71 and the gate driver. The protection circuit 72 is realized by disposing a diode between two signal transmission lines that are adjacent to each other, as shown in FIG. 16. It should be noted that circuits in each of which two diodes facing opposite directions are connected in parallel as indicated by a reference sign 75 in FIG. 16 are referred to as "diode rings". As shown in FIG. 17, each of the diode rings is specifically realized by a first diode 76 that is constituted by a first transistor 78, and a second diode 77 that is constituted by a second transistor 79. A gate terminal and a source terminal of the first transistor 78 are connected, and thus thereby realizing an anode of the first diode 76. A cathode of the first diode 76 is realized by a drain terminal of the first transistor 78. A gate terminal and a source terminal of the second transistor 79 are connected, and thus thereby realizing an anode of the second diode 77. A cathode of the second diode 77 is realized by a drain terminal of the second transistor 79. The anode of the first diode 76 and the cathode of the second diode 77 are connected to one signal transmission line 7*a*, and the cathode of the first diode 76 and the anode of the second diode 77 are connected to the other signal transmission line 7*b*. As the diode rings thus configured are provided between the signal transmission lines, even if static electricity is applied to any of the signal transmission lines, a charge due to the static electricity flows from the signal transmission line to which the static electricity is applied to different signal transmission lines. With this, electrostatic breakdown of the circuit element within the gate driver may be prevented.

Further, with the liquid crystal display device having a monolithic gate driver, in order to reduce power consumption, a technique called "charge sharing" is employed in some cases in which two signal transmission lines (specifically, a signal transmission line transmitting a gate clock signal that is to change from a low level to a high level, and a signal transmission line transmitting a gate clock signal that is to change from a high level to a low level) are short-circuited when a level (signal potential) of the gate clock signal is changed. For a liquid crystal display device employing charge sharing, focusing on the gate clock signal CK1 and the gate clock signal CK1B whose phases are displaced by 180 degrees, for example, the CK1 transmission line and the CK1B transmission line are short-circuited when the levels of these signals are changed.

FIG. 18 is a diagram showing a schematic configuration for charge sharing. Here, an attention is focused on charge sharing between a CK1 transmission line 813 and a CK1B transmission line 814. It should be noted that, in FIG. 18, an external circuit that generates the gate clock signals CK1 and CK1B is indicated by a reference sign 800. The CK1 transmission line 813 is connected to the external circuit 800 via a switch 811*a*, and the CK1B transmission line 814 is connected to the external circuit 800 via a switch 811*b*. A switch 812 is provided between the CK1 transmission line 813 and the CK1B transmission line 814.

In the above configuration, the switches 811*a* and 811*b* are turned to an off state and the switch 812 is turned to an on state, when a potential of the CK1 transmission line 813 (i. e., the gate clock signal CK1) is changed from a high level (the gate high potential Vgh) to a low level (the gate low potential Vgl) and when a potential of the CK1B transmission line 814 (i. e., the gate clock signal CK1B) is changed from a high level (the gate high potential Vgh) to a low level (the gate low potential Vgl). As a result, the CK1 transmission line 813 and the CK1B transmission line 814 are short-circuited. With this, in a case where the potential of the CK1 transmission line 813 is changed from the high level to the low level, as in a period from a time point t91 to a time point t92 in FIG. 19, the short-circuit between the CK1 transmission line 813 and the CK1B transmission line 814 causes the potential of the CK1 transmission line 813 to gradually decrease from the high level, and the potential of the CK1B transmission line 814 to gradually increase from the low level. Then, at the time point t92, the switch 812 is turned to the off state and the switches 811*a* and 811*b* are turned to the on state. At this time, from the external circuit 800, a low-level direct power-supply voltage is outputted as the gate clock signal CK1, and a high-level direct power-supply voltage is outputted as the gate clock signal CK1B. With this, at the time point t92, the potential of the CK1 transmission line 813 becomes low level (the gate low potential Vgl), and the potential of the CK1B transmission line 814 becomes high level (the gate high potential Vgh). Here, during the period from the time point t91 to the time point t92, no current flows between a power source and the CK1 transmission line 813, and between the power source and the CK1B transmission line 814. Therefore, power consumption may be reduced as compared to a configuration in which charge sharing is not employed.

As described above, with the display device having a monolithic gate driver, electrostatic breakdown of a circuit element within the monolithic gate driver is prevented by providing a protection circuit, and power consumption is reduced by employing charge sharing.

However, in the display device having a monolithic gate driver, in a case in which the protection circuit described above is provided and charge sharing is employed, horizontal stripes may be shown on a screen. This phenomenon will be described in the following.

First, basic matter regarding writing (writing of a video signal) to a pixel capacitance within a display unit will be described. FIG. 20 is a signal waveform diagram when positive writing to the pixel capacitance is performed, and FIG. 21 is a signal waveform diagram when negative writing to the pixel capacitance is performed. Here, in FIG. 20 and FIG. 21, a common electrode potential is indicated by a reference sign Vcom. When positive writing is performed, as shown in FIG. 20, after a video signal V reaches a desired potential, a potential of a scanning signal G changes from a gate low potential Vgl to a gate high potential Vgh. With this, a pixel electrode potential (a drain potential of pixel TFTs) VP increases. Thereafter, the potential of the scanning signal G changes from the gate high potential Vgh to the gate low potential Vgl. At this time, due to capacitive coupling around the pixel TFTs, the pixel electrode potential VP decreases as the potential of the scanning signal G decreases (see a portion indicated by a reference sign 81 in FIG. 20). As a result, a voltage of a magnitude represented by an arrow indicated by a reference sign 82 is applied to the liquid crystal. When negative writing is performed, as shown in FIG. 21, after the video signal V reaches a desired potential, the potential of the scanning signal G changes from the gate low potential Vgl to the gate high potential Vgh. With this, the pixel electrode potential VP decreases. Thereafter, the potential of the scanning signal G changes from the gate high potential Vgh to the gate low potential Vgl. At this time, due to capacitive coupling around the pixel TFTs, the pixel electrode potential VP decreases as the potential of the scanning signal G decreases (see a portion indicated by a reference sign 83 in FIG. 21). As a result, a voltage of a magnitude represented by an arrow indicated by a reference sign 84 is applied to the liquid crystal. It should be noted that a voltage corresponding to the decrease of the pixel electrode potential VP along with the decrease of the potential of the scanning signal G is referred to as a "pull-in voltage" or a "feed-through voltage".

Regarding the waveform of the scanning signal G shown in FIG. 20 and FIG. 21, an ideal waveform is a rectangular waveform as shown by a broken line in FIG. 22. However, in practice, a delay (rounding of waveform) is occurred as shown by a solid line in FIG. 22. If a delay is occurred in the waveform of the scanning signal G in the same manner for all lines, a magnitude of the pull-in voltage becomes similar for all lines. However, if a magnitude of the delay occurred in the waveform of the scanning signal G is different by line, the magnitude of the pull-in voltage differs for each line. In this case, an optimal opposing potential (a common electrode potential at which a voltage applied to the liquid crystal in positive writing and a voltage applied to the liquid crystal in negative writing are the same) also differs for each line. As a result, even if setting (setting of the common electrode potential) is performed such that the common electrode potential matches an optimal opposing potential of one line, there is a line at which the common electrode potential does not match the optimal opposing potential, and thus horizontal stripes are occurred in a screen. In a case in which the protection circuit described above is provided and charge sharing is employed for the display device having a monolithic gate driver, a magnitude of the pull-in voltage differs for each line, and horizontal stripes are occurred in a screen.

Regarding the protection circuit described above, if the diode rings are low-resistance, there is a case in which a leak current is occurred between two adjacent signal transmission lines. For example, there is a case in which a leak current 931 from a signal transmission line 911 via a diode ring 921 and a leak current 932 from a signal transmission line 913 via a diode ring 922 are occurred when a potential of a signal transmission line 912 in FIG. 23 should change from the high level to the low level. At this time, the potential of the signal transmission line 912 at a time point when charge sharing ends depends on a direction and a magnitude of a leak current. FIG. 19 shows a waveform of a potential of the CK1 transmission line (i. e., the gate clock signal CK1), and a change in the waveform depends on a direction and a magnitude of a leak current between the CK1 transmission line and a signal transmission line adjacent thereto. Specifically, if a potential of an adjacent signal line (a signal transmission line adjacent to the CK1 transmission line) is at the high level during the period from the time point t91 to the time point t92, the potential of the CK1 transmission line changes as shown by a dotted line as indicated by a reference sign 96 in FIG. 24. If the potential of the adjacent signal line is at the low level during the period from the time point t91 to the time point t92, the potential of the CK1 transmission line changes as shown by a dotted line as indicated by a reference sign 97 in FIG. 24. In this manner, the potential of the gate clock signal at the time point when charge sharing ends in a case in which the gate clock signal changes from the high level to the low level changes depending on the potential of the adjacent signal line during a period in which charge sharing is performed.

In the case of a conventional liquid crystal display device having a monolithic gate driver, for example, potentials at the end time point of charge sharing when four gate clock signals change from the high level to the low level are not identical, due to the following reasons. It should be noted that in this specification, regarding any of the gate clock signal transmission line, two signal transmission lines that are adjacent thereto are defined as a first adjacent signal line and a second adjacent signal line, and a combination of a potential of the first adjacent signal line and a potential of the second adjacent signal line when a potential of the focused gate clock signal transmission line changes from the high level to the low level is defined as an adjacent signal line state.

In a case in which a plurality of signal transmission lines are disposed on a TFT substrate as shown in FIG. 15 and FIG. 16 and waveforms of the gate clock signals CK1, CK1B, CK2, and CK2B are as shown in FIG. 25, changes in the potentials of the first adjacent signal line and the second adjacent signal line before and after a time point when a potential of each of the gate clock signal transmission lines changes from the high level (the gate high potential Vgh) to the low level (the gate low potential Vgl) are as shown in FIG. 26. In FIG. 26, timing at which a potential of each of the gate clock signal transmission lines changes from the high level to the low level is indicated by a reference sign td. Regarding FIG. 26, a portion indicated by a reference sign 99 shows changes in potentials of the CK1 transmission line (the first adjacent signal line for the CK2 transmission line), the CK2 transmission line, and the CK1B transmission line (the second adjacent signal line for the CK2 transmission line) (i. e., changes in potentials of the gate clock signals CK1, CK2, and CK1B) before and after a time point when a potential of the CK2 transmission line (i. e., a potential of the gate clock signal CK2) changes from the high level to the low level. Here, although, in practice, a period in which each of the gate clock signals changes from the high level to the low level has a certain length as shown in FIG. 19 (the period from the time point t91 to the time point t92 in FIG. 19), FIG. 26 shows this period as one time point for convenience sake.

In FIG. 26, a focus is given to the CK1 transmission line. At timing td at which the potential of the CK1 transmission line changes from the gate high potential Vgh to the gate low potential Vgl, a potential of the VSS transmission line as the first adjacent signal line is the gate low potential Vgl, and a potential of the CK2 transmission line as the second adjacent signal line is the gate high potential Vgh. In FIG. 26, a focus is given to the CK2 transmission line. At the timing td at which the potential of the CK2 transmission line changes from the gate high potential Vgh to the gate low potential Vgl, the potential of the CK1 transmission line as the first adjacent signal line is the gate low potential Vgl, and the potential of the CK1B transmission line as the second adjacent signal line is the gate high potential Vgh. In FIG. 26, a focus is given to the CK1B transmission line. At the timing td at which the potential of the CK1B transmission line changes from the gate high potential Vgh to the gate low potential Vgl, the potential of the CK2 transmission line as the first adjacent signal line is the gate low potential Vgl, and the potential of the CK2B transmission line as the second adjacent signal line is the gate high potential Vgh. In FIG. 26, a focus is given to the CK2B transmission line. At the timing td at which the potential of the CK2B transmission line changes from the gate high potential Vgh to the gate low potential Vgl, the potential of the CK1B transmission line as the first adjacent signal line is the gate low potential Vgl, and the potential of the GSP transmission line as the second adjacent signal line is also the gate low potential Vgl.

As described above, regarding the CK1 transmission line, the CK2 transmission line, and the CK1B transmission line, at the timing at which the potential changes from the gate high potential Vgh to the gate low potential Vgl, the potential of the first adjacent signal line is the gate low potential Vgl, and the potential of the second adjacent signal line is the gate high potential Vgh. On the other hand, regarding the CK2B transmission line, at the timing at which the potential changes from the gate high potential Vgh to the gate low potential Vgl, the potential of the first adjacent signal line is the gate low potential Vgl, and the potential of the second adjacent signal line is also the gate low potential Vgl. In this manner, the adjacent signal line state of the CK1 transmission line, the CK2 transmission line, and the CK1B transmission line, and the adjacent signal line state of the CK2B transmission line are different. Therefore, the potential of the CK2B transmission line at the time point when charge sharing ends is different from the potentials of the CK1 transmission line, the CK2 transmission line, and the CK1B transmission line at the time point when charge sharing ends. Specifically, the waveform when the gate clock signal CK2B changes from the gate high potential Vgh to the gate low potential Vgl is different from the waveform when the gate clock signals CK1, CK2, and CK1B change from the gate high potential Vgh to the gate low potential Vgl. Therefore, the pull-in voltage of the scanning signal G for a line to which the gate clock signal CK2B is supplied as the scanning signal G is different from the pull-in voltage of the scanning signal G for a line to which one of the gate clock signals CK1, CK2, and CK1B is supplied as the scanning signal G. As a result, horizontal stripes are occurred in a screen. Such horizontal stripes are easily seen particularly when a screen is displayed all in the same halftone gradation.

SUMMARY OF THE INVENTION

Thus, it is desired to suppress occurrence of horizontal stripes due to a leak current between signal transmission lines in a display device having a monolithic gate driver.

(1) Display devices according to several embodiments of the present invention are each a display device having a display panel including a display unit on which a plurality of scanning signal lines are disposed, the display device including:

a scanning signal line drive circuit configured to drive the plurality of scanning signal lines, the scanning signal line drive circuit being formed in a monolithic manner on a panel substrate that constitutes the display panel; and a signal input terminal disposed on the panel substrate, the signal input terminal receiving at least a plurality of scanning control signals for controlling an operation of the scanning signal line drive circuit, wherein the plurality of scanning control signals include a plurality of scanning control clock signals that are clock signals having four or more phases, a plurality of signal transmission lines are disposed between the signal input terminal and the scanning signal line drive circuit, the plurality of signal transmission lines including a plurality of scanning control clock signal transmission lines respectively transmitting the plurality of scanning control clock signals, and regarding any scanning control clock signal transmission line, assuming that two signal transmission lines that are adjacent to the focused scanning control clock signal transmission line are defined as a first adjacent signal line and a second adjacent signal line, and assuming that a combination of a potential of the first adjacent signal line and a potential of the second adjacent signal line when a potential of the focused scanning control clock signal transmission line changes from a high level to a low level is defined as an adjacent signal line state, the adjacent signal line state is identical for all of the plurality of scanning control clock signal transmission lines.

According to such a configuration, in the display device having a monolithic gate driver, a plurality of scanning control clock signals as clock signals having four or more phases is used in order to control an operation of the monolithic gate driver. Between the signal input terminal and the monolithic gate driver, a plurality of signal transmission lines including a plurality of scanning control clock signal transmission lines respectively transmitting a plurality of scanning control clock signals are disposed. In this configuration, the plurality of signal transmission lines are disposed so that the adjacent signal line state (combination of the potential of the first adjacent signal line and the potential of the second adjacent signal line when the potential of the scanning control clock signal transmission line changes from the high level to the low level) for all of the plurality of scanning control clock signal transmission lines becomes the same. Therefore, a leak current is occurred in the same manner when charge sharing is performed between the scanning control clock signal transmission lines, regardless of the scanning control clock signal transmission line subjected to charge sharing. Accordingly, a signal waveform when the signal potential changes from the high level to the low level becomes similar for all of the scanning control clock signals. With this, a magnitude of the pull-in voltage due to a falling edge of the scanning signal becomes almost similar for all of the lines. As a result, occurrence of horizontal stripes on a screen is suppressed. As described above, in the display device having a monolithic gate driver, occurrence of horizontal stripes due to a leak current between the signal transmission lines is suppressed.

(2) Moreover, display devices according to several embodiments of the present invention are each a display device including the configuration of above (1), wherein the adjacent signal line state is identical for all of the plurality of scanning control clock signal transmission lines by providing a dummy signal transmission line adjacent to any of the plurality of scanning control clock signal transmission lines.

(3) Moreover, display devices according to several embodiments of the present invention are each a display device including the configuration of above (2), wherein the dummy signal transmission line transmits a dummy signal different from the plurality of scanning control signals, and the signal input terminal includes a terminal to which the dummy signal is inputted from outside of the display panel.

(4) Moreover, display devices according to several embodiments of the present invention are each a display device including the configuration of above (2), wherein one of the plurality of scanning control signals is supplied to the dummy signal transmission line, by leading a corresponding signal transmission line over the panel substrate.

(5) Moreover, display devices according to several embodiments of the present invention are each a display device including the configuration of above (1), wherein the adjacent signal line state is identical for all of the plurality of scanning control clock signal transmission lines by providing a high voltage signal transmission line adjacent to any of the plurality of scanning control clock signal transmission lines, the high voltage signal transmission line transmitting a high-level voltage.

(6) Moreover, display devices according to several embodiments of the present invention are each a display device including the configuration of any one of above (1) to (5), wherein regarding any scanning control clock signal transmission line, when the potential of the focused scanning control clock signal transmission line changes from the high level to the low level, the potential of one of the first adjacent signal line and the second adjacent signal line is maintained at the high level, and the potential of the other of the first adjacent signal line and the second adjacent signal line is maintained at the low level.

(7) Moreover, display devices according to several embodiments of the present invention are each a display device further including a short-circuit control unit for causing two scanning control clock signal transmission lines to be short-circuited to each other in addition to the configuration of any one of above (1) to (6), wherein to any scanning control clock signal transmission line, a cathode of a diode whose anode is connected to the first adjacent signal line, an anode of a diode whose cathode is connected to the first adjacent signal line, a cathode of a diode whose anode is connected to the second adjacent signal line, and an anode of a diode whose cathode is connected to the second adjacent signal line are connected, the plurality of scanning control clock signal transmission lines are divided into groups each including two scanning control clock signal transmission lines respectively transmitting two scanning control clock signals whose phases are displaced by 180 degrees, and when the potential of any scanning control clock signal transmission line is to change from the high level to the low level, the short-circuit control unit causes one pair of two scanning control clock signal transmission lines including the focused scanning control clock signal transmission line to be short-circuited.

(8) Moreover, display devices according to several embodiments of the present invention are each a display device including the configuration of above (7), wherein two scanning control clock signal transmission lines that are short-circuited by the short-circuit control unit are unadjacent.

These and other objects, features, aspects, and effects of the present invention will be made more clear from the following detailed description of the present invention with reference to the accompanying drawings.

DETAILED DESCRIPTION OF PREFERRED EMBODIMENTS

Hereinafter, one embodiment will be described with reference to the drawings.

1. Overall Configuration

Figure 1:
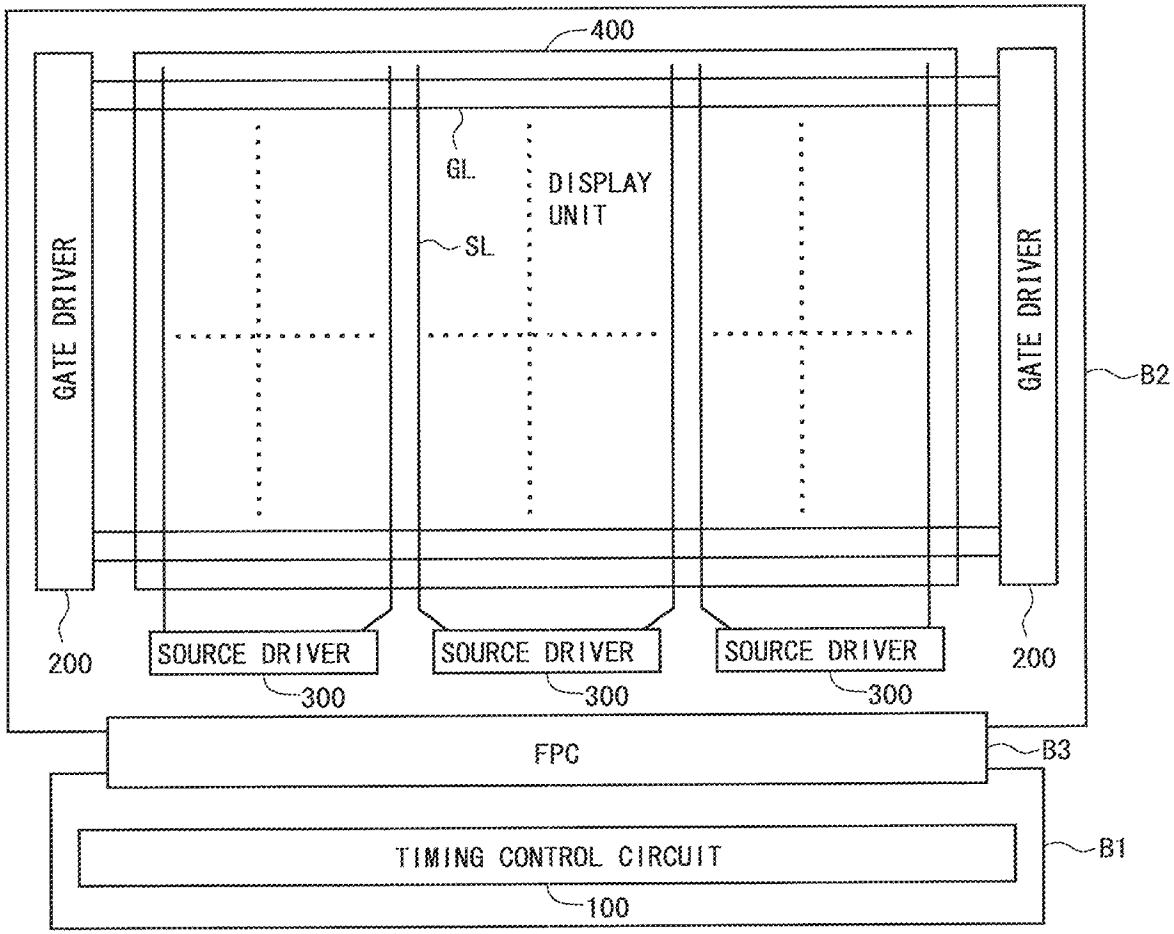
FIG. 1 is a block diagram illustrating an overall configuration of a liquid crystal display device according to one embodiment.

FIG. 1 is a block diagram illustrating an overall configuration of a liquid crystal display device according to one embodiment. This liquid crystal display device includes a timing control circuit 100, gate drivers (scanning signal line drive circuits) 200, source drivers (video signal line drive circuits) 300, and a display unit 400. The timing control circuit 100 is mounted on a control substrate B1 in a form of an IC chip, for example. A TFT substrate (array substrate) B2 that is one of two glass substrates constituting a liquid crystal panel is provided with the gate drivers 200 and the display unit 400 in a monolithic manner (that is, the gate drivers 200 are a monolithic gate driver), and the source drivers 300 are mounted in a form of IC chips (three IC chips in the example of FIG. 1), for example. Above a region in which the gate drivers 200 and the display unit 400 are provided, a color filter substrate is disposed so as to face against the TFT substrate B2. Specifically, the liquid crystal panel is constituted by the TFT substrate B2 and the color filter substrate. The control substrate B1 and the TFT substrate B2 are connected via an FPC (flexible printed circuit) B3. Although the gate drivers 200 are disposed on both ends of the display unit 400 in the example shown in FIG. 1, the configuration is not limited to this example. For example, the gate driver 200 may be provided only on one end of the display unit 400.

Figure 2:
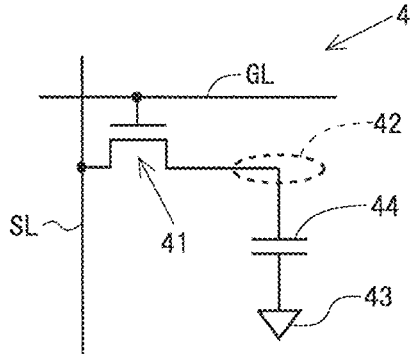
FIG. 2 is a circuit diagram illustrating a configuration of a single pixel formation portion according to the embodiment.

The display unit 400 is provided with a plurality of source bus lines (video signal lines) SL and a plurality of gate bus lines (scanning signal lines) GL. Within the display unit 400, pixel formation portions for forming pixels are provided respectively at intersections between the source bus lines SL and the gate bus lines GL. FIG. 2 is a circuit diagram illustrating a configuration of one of pixel formation portions 4. Each of the pixel formation portions 4 includes: a TFT (pixel TFT) 41 as a switching element having a gate terminal connected to one of the gate bus lines GL that passes an intersection corresponding to this pixel formation portion 4, and having a source terminal connected to one of the source bus lines SL that passes this intersection; a pixel electrode 42 connected to a drain terminal of the TFT 41; a common electrode 43 to which a constant voltage is applied; and a liquid crystal capacitance 44 constituted by the pixel electrode 42 and the common electrode 43. It should be noted that there is a case in which an auxiliary capacitance is provided in parallel with the liquid crystal capacitance 44.

An operation mode of the liquid crystal is not particularly limited. It is possible to employ a lateral electric field mode such as an AFFS mode or an IPS mode, or longitudinal electric field mode such as a TN mode or an ASV mode.

Figure 3:
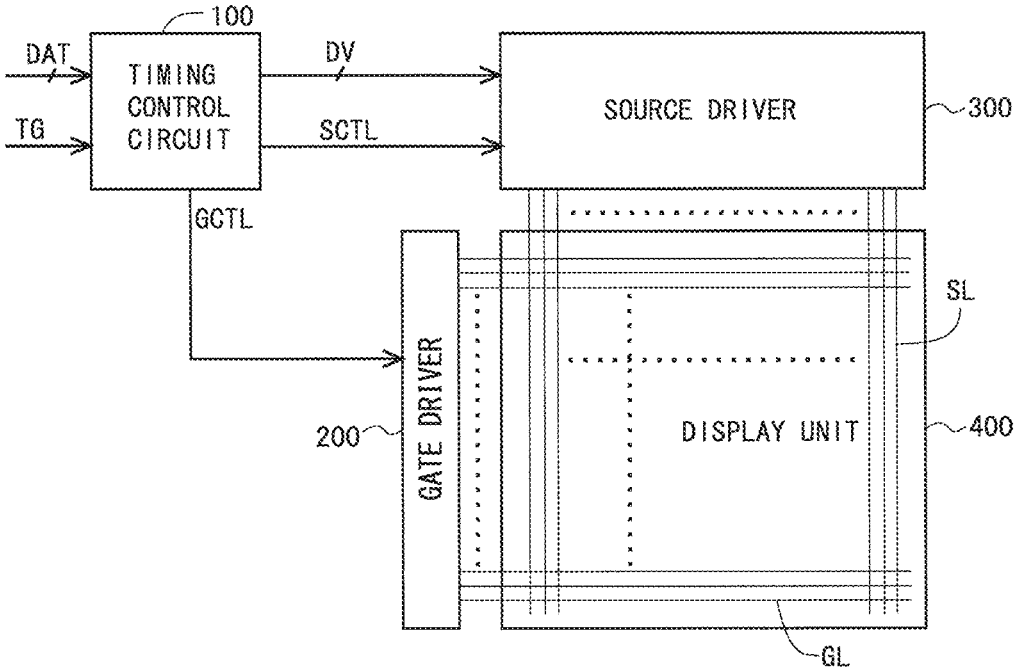
FIG. 3 is a functional block diagram illustrating a functional configuration of the liquid crystal display device according to the embodiment.

FIG. 3 is a functional block diagram illustrating a functional configuration of the liquid crystal display device according to this embodiment. As described above, the liquid crystal display device includes the timing control circuit 100, the gate drivers 200, the source drivers 300, and the display unit 400.

The timing control circuit 100 receives the image data DAT and a timing signal group TG, such as a horizontal synchronization signal and a vertical synchronization signal, that are supplied from outside, and outputs a digital video signal DV, a gate control signal (scanning control signal) GCTL for controlling an operation of the gate drivers 200, and a source control signal SCTL for controlling an operation of the source drivers 300. The gate control signal GCTL includes a gate start pulse signal and a gate clock signal. The source control signal SCTL includes a source start pulse signal, a source clock signal, and a latch strobe signal.

The gate drivers 200 repeat application of active scanning signals to each of the gate bus lines GL with one vertical scanning period as a cycle, based on the gate control signal GCTL transmitted from the timing control circuit 100. Details of the gate drivers 200 will be described later.

The source drivers 300 apply driving video signals to the source bus lines SL, based on the digital video signal DV and the source control signal SCTL transmitted from the timing control circuit 100. At this time, at timing at which a pulse of the source clock signal is generated, the source driver 300 sequentially holds the digital video signal DV indicating a voltage to be applied to each of the source bus lines SL. Then, at timing at which a pulse of the latch strobe signal is generated, the digital video signals DV that are held are converted into analog voltages. The converted analog voltages are applied to all of the source bus lines SL at once as the driving video signals.

As described above, by applying the scanning signals to the gate bus lines GL, and by applying the driving video signals to the source bus lines SL, an image corresponding to the image data DAT that is externally supplied is displayed in the display unit 400.

2. Gate Driver

Next, a configuration of the gate drivers 200 will be described. It should be noted that the configuration described here is merely an example, and a variety of different configuration may be employed.

<2.1 Shift Register>

Figure 4:
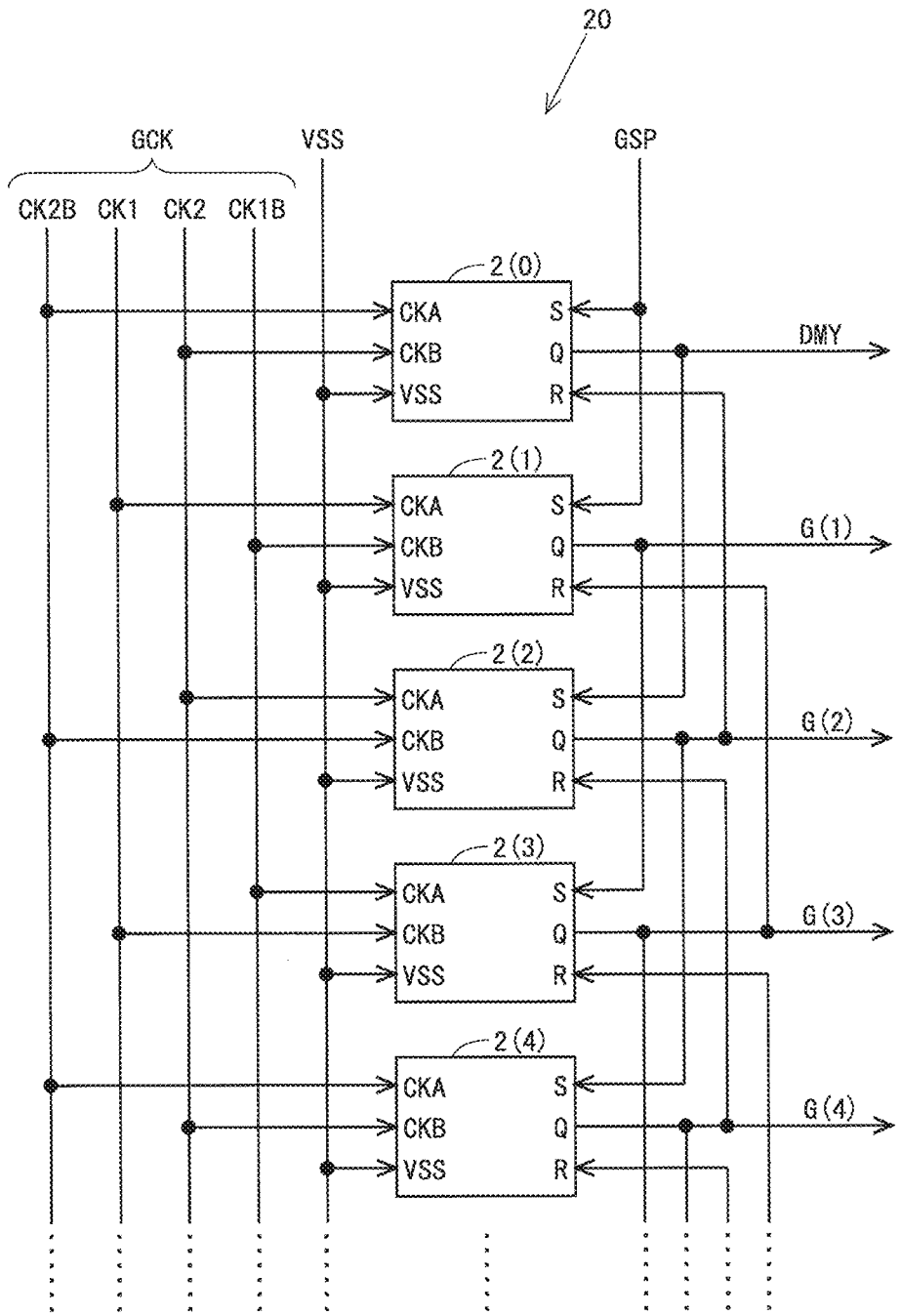
FIG. 4 is a block diagram illustrating a configuration of a gate driver according to the embodiment.

As shown in FIG. 4, each of the gate drivers 200 is constituted by a shift register 20 including a plurality of stages. Here, in this specification, a circuit that constitutes each of the stages of the shift register is referred to as a "unit circuit". FIG. 4 only shows a unit circuit 2(0) for dummy output and unit circuits 2(1) to 2(4) of a first to a fourth stage. Each unit circuit 2 includes input terminals for respectively receiving a first clock CKA, a second clock CKB, a low-level direct power-supply voltage VSS, a set signal S, and a reset signal R, and an output terminal for outputting an output signal Q.

Figure 25:
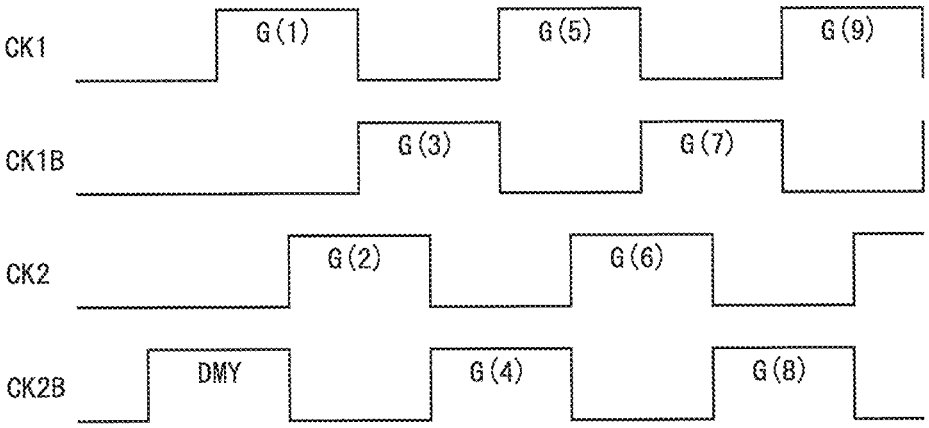
FIG. 25 is a signal waveform diagram for four gate clock signals according to the conventional example.

To the shift register 20, as the gate control signal GCTL, a gate start pulse signal GSP and gate clock signals CK1, CK1B, CK2, and CK2B as four-phase clock signals are supplied. Potentials of the gate clock signals CK1, CK1B, CK2, and CK2B on a high-level side is a gate high potential Vgh, and potentials of the gate clock signals CK1, CK1B, CK2, and CK2B on a low-level side is a gate low potential Vgl. To the shift register 20, the low-level direct power-supply voltage VSS is also supplied. Waveforms of the gate clock signals CK1, CK1B, CK2, and CK2B are as shown in FIG. 25. Specifically, phases of the gate clock signal CK1 and the gate clock signal CK1B are displaced by 180 degree, phases of the gate clock signal CK2 and the gate clock signal CK2B are displaced by 180 degrees, and the phase of the gate clock signal CK1 is advancing from the phase of the gate clock signal CK2 by 90 degrees. Here, FIG. 25 shows that each pulse corresponds to which scanning signal. For example, a pulse indicated by G(5) corresponds to a scanning signal supplied to a gate bus line of a fifth line. In the present specification, the gate clock signal is indicated by a reference sign GCK when the gate clock signals CK1, CK1B, CK2, and CK2B are collectively referred to. In this embodiment, a scanning control clock signal is realized by the gate clock signal GCK.

Signals supplied to the input terminals of each stage (each unit circuit 2) of the shift register 20 are as follows (see FIG. 4). Regarding the gate clock signal GCK, the gate clock signal CK1 as the first clock CKA and the gate clock signal CK1B as the second clock CKB are supplied to the unit circuit 2(1) of the first stage, the gate clock signal CK2 as the first clock CKA and the gate clock signal CK2B as the second clock CKB are supplied to the unit circuit 2(2) of the second stage, the gate clock signal CK1B as the first clock CKA and the gate clock signal CK1 as the second clock CKB are supplied to the unit circuit 2(3) of the third stage, and the gate clock signal CK2B as the first clock CKA and the gate clock signal CK2 as the second clock CKB are supplied to the unit circuit 2(4) of the fourth stage. This configuration is repeated from the fifth stage by four stages. It should be noted that, to the unit circuit 2(0) for dummy output, the gate clock signal CK2B as the first clock CKA and the gate clock signal CK2 as the second clock CKB are supplied.

Further, to the unit circuit 2($n$) of any stage (here, n-th stage), the output signal Q outputted from the unit circuit 2($n$−2) two stages before is supplied as the set signal S, and the output signal Q outputted from the unit circuit 2($n$+2) two stages after is supplied as the reset signal R. However, to the unit circuits 2(0) and 2(1), the gate start pulse signal GSP is supplied as the set signal S. The low-level direct power-supply voltage VSS is commonly supplied to all of the unit circuits 2. It should be noted that although the configuration in which the same gate start pulse signal GSP is supplied as the set signal S to the unit circuits 2(0) and 2(1) is shown in this embodiment, a configuration in which different gate start pulse signals are supplied respectively to the unit circuit 2(0) and the unit circuit 2(1) may be employed.

From the output terminal of each stage (each unit circuit 2) of the shift register 20, the output signal Q is outputted (see FIG. 4). The output signal Q outputted from any stage (here, n-th stage) is supplied to the gate bus line GL(n) as a scanning signal G(n), as well as to the unit circuit 2($n$−2) two stages before as the reset signal R, and to the unit circuit 2($n$+2) two stages after as the set signal S. However, the output signals Q outputted from the unit circuits 2(0) and 2(1) are not supplied to the other unit circuits 2 as the reset signal R. Further, the output signal Q outputted from the unit circuit 2(0) becomes a signal DMY for dummy output, and is not supplied to the gate bus line GL.

Figure 5:
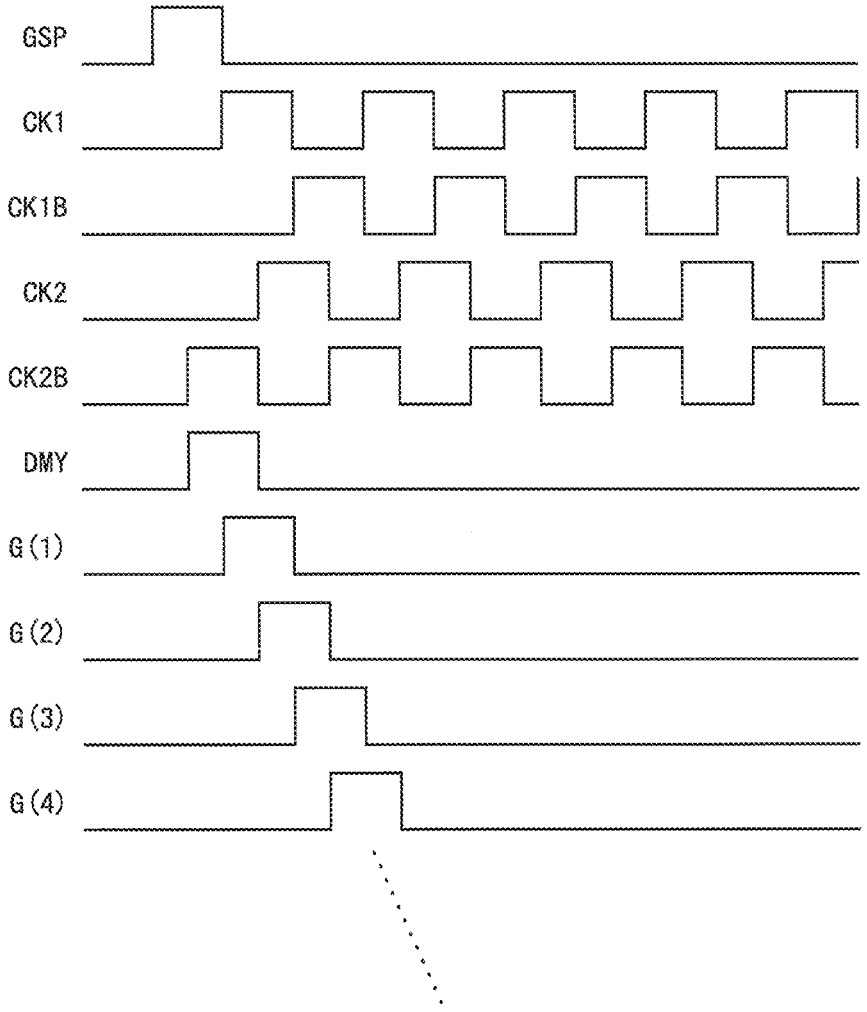
FIG. 5 is a signal waveform diagram for illustration of an operation of the gate driver according to the embodiment.

FIG. 5 is a signal waveform diagram for illustration of an operation of the gate drivers 200. In the above configuration, when a pulse of the gate start pulse signal GSP as the set signal S is supplied to the unit circuits 2(0) and 2(1) within the shift register 20, a shift operation of the shift register 20 is performed based on clock operations of the gate clock signals CK1, CK2, CK1B, and CK2B. Specifically, the output signal Q outputted from each of the unit circuits 2 is sequentially turned to the high level. With this, as can be seen from FIG. 5, the gate bus lines GL within the display unit 400 sequentially become a selected state.

<2.2 Configuration of Unit Circuit>

Figure 6:
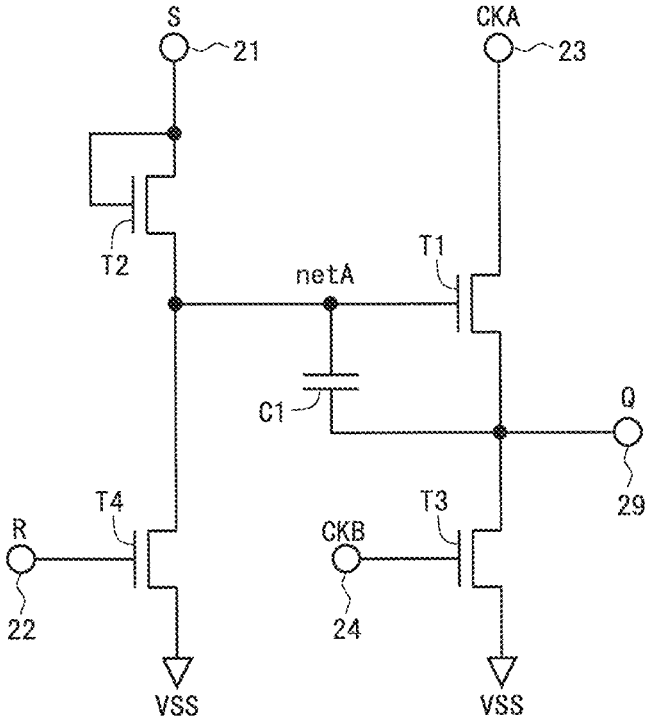
FIG. 6 is a circuit diagram illustrating an example of a configuration of a unit circuit within a shift register according to the embodiment.

FIG. 6 is a circuit diagram illustrating an example of a configuration of the unit circuit 2 within the shift register 20. As shown in FIG. 6, the unit circuit 2 includes four thin-film transistors T1 to T4 and one capacitor (capacitative element) C1. Further, the unit circuit 2 includes an input terminal for the low-level direct power-supply voltage VSS, as well as four input terminals 21 to 24 and one output terminal 29. Here, an input terminal for receiving the set signal S is indicated by a reference sign 21, an input terminal for receiving the reset signal R is indicated by a reference sign 22, an input terminal for receiving the first clock CKA is indicated by a reference sign 23, and an input terminal for receiving the second clock CKB is indicated by a reference sign 24.

Next, connection relationship between components within the unit circuit 2 will be described. A gate terminal of the thin-film transistor T1, a source terminal of the thin-film transistor T2, a drain terminal of the thin-film transistor 14, and one end of the capacitor C1 are connected to each other. Here, an area (wiring) in which these terminals are connected is referred to as an "output control node". The output control node is indicated by a reference sign netA.

Regarding the thin-film transistor T1, the gate terminal is connected to the output control node netA, a drain terminal is connected to the input terminal 23, and a source terminal is connected to the output terminal 29. Regarding the thin-film transistor T2, gate terminal and a drain terminal are connected to the input terminal 21 (that is, diode-connected), and the source terminal is connected to the output control node netA. Regarding the thin-film transistor T3, a gate terminal is connected to the input terminal 24, a drain terminal is connected to the output terminal 29, and a source terminal is connected to the input terminal for the low-level direct power-supply voltage VSS. Regarding the thin-film transistor T4, a gate terminal is connected to the input terminal 22, the drain terminal is connected to the output control node netA, and a source terminal is connected to the input terminal for the low-level direct power-supply voltage VSS. Regarding the capacitor C1, the one end is connected to the output control node netA, and the other end is connected to the output terminal 29.

Next, functions of the components will be described. The thin-film transistor T1 supplies a potential of the first clock CKA to the output terminal 29, when a potential of the output control node netA is at a high level. The thin-film transistor T2 changes the potential of the output control node netA to the high level when the set signal S is at the high level. The thin-film transistor T3 changes a potential of the output terminal 29 to the low level, when the second clock CKB is at the high level. The thin-film transistor T4 changes the potential of the output control node netA to the low level, when the reset signal R is at the high level.

<2.3 Operation of Unit Circuit>

Figure 7:
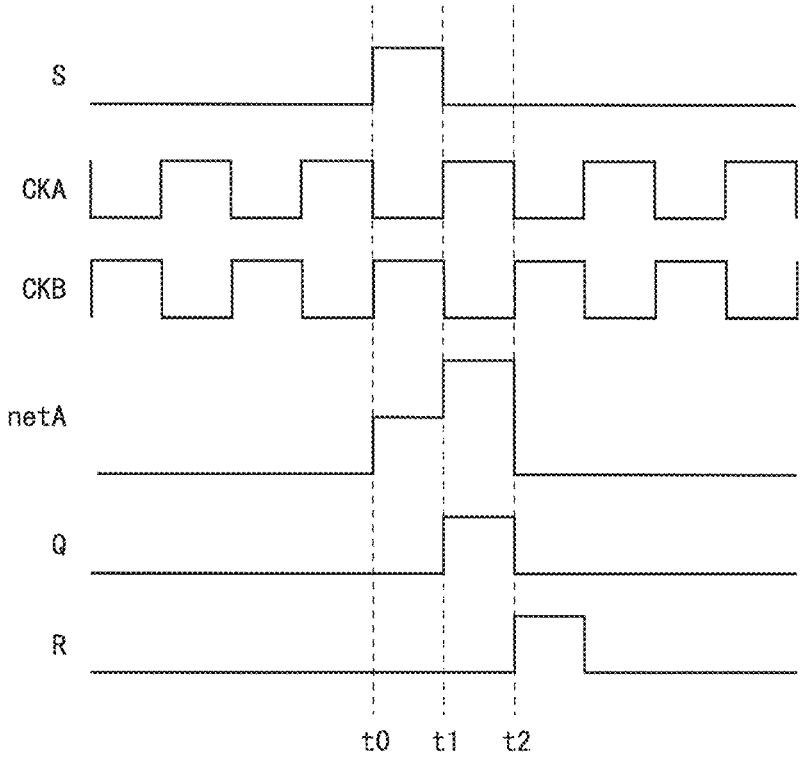
FIG. 7 is a signal waveform diagram for illustrating an operation of the unit circuit according to the embodiment.

An operation of the unit circuit 2 will be described with reference to FIG. 7. During a period in which the liquid crystal display device is operated, the first clock CKA and the second clock CKB whose on duty is set to be about 50% are supplied to the unit circuit 2. During a period before a time point t0, the potential of the output control node netA and a potential of the output signal Q are maintained at the low level.

At the time point t0, a pulse of the set signal S is supplied to the input terminal 21. As the thin-film transistor T2 is diode-connected as shown in FIG. 6, the thin-film transistor T2 is turned to the on state by the pulse of the set signal S, and the capacitor C1 is charged. With this, the potential of the output control node netA increases, and the thin-film transistor T1 is turned to the on state. Here, during a period from the time point t0 to a time point t1, the first clock CKA is at the low level. Therefore, during this period, the output signal Q is maintained at the low level. Further, during the period from the time point t0 to the time point t1, as the reset signal R is at the low level, the thin-film transistor T4 is maintained in the off state. Therefore, the potential of the output control node netA may not decrease during this period.

At the time point t1, the first clock CKA changes from the low level to the high level. At this time, as the thin-film transistor T1 is in the on state, the potential of the output terminal 29 increases as the potential of the input terminal 23 increases. Here, as the capacitor C1 is provided between the output control node netA and the output terminal 29 as shown in FIG. 6, the potential of the output control node netA also increases as the potential of the output terminal 29 increases (the output control node netA is boosted). As a result, a large voltage is applied to the gate terminal of the thin-film transistor T1, and the potential of the output signal Q increases up to a high level potential of the first clock CKA. With this, the gate bus line GL connected to the output terminal 29 of this unit circuit becomes the selected state. Here, during a period from the time point t1 to a time point t2, the second clock CKB is at the low level. Therefore, the thin-film transistor T3 is maintained in the off state, and the potential of the output signal Q may not decrease during this period.

At the time point t2, the first clock CKA changes from the high level to the low level. With this, the potential of the output terminal 29 (the potential of the output signal Q) decreases as the potential of the input terminal 23 decreases, and the potential of the output control node netA also decreases via the capacitor C1. Further, the pulse of the reset signal R is supplied to the input terminal 22 at the time point t2. With this, the thin-film transistor T4 becomes the on state. As a result, the potential of the output control node netA changes from the high level to the low level. Further, at the time point t2, the second clock CKB changes from the low level to the high level. With this, the thin-film transistor T3 becomes the on state. As a result, the potential of the output terminal 29 (the potential of the output signal Q) is turned to the low level.

3. Configuration and Operation for Charge Sharing

Next, a configuration and an operation for charge sharing described above will be described. In this embodiment, the four gate clock signals CK1, CK1B, CK2, and CK2B having waveforms as shown in FIG. 25 are used. Therefore, charge sharing is performed between the CK1 transmission line and the CK1B transmission line, and charge sharing is performed between the CK2 transmission line and the CK2B transmission line. Specifically, the gate clock signal transmission lines disposed on the TFT substrate B2 are divided into groups each including two gate clock signal transmission lines respectively transmitting two gate clock signals whose phases are displaced by 180 degrees, and charge sharing is performed, when a potential of any gate clock signal transmission line is to change from the high level to the low level, between one pair of two gate clock signal transmission lines including the focused gate clock signal transmission line.

Figure 8:
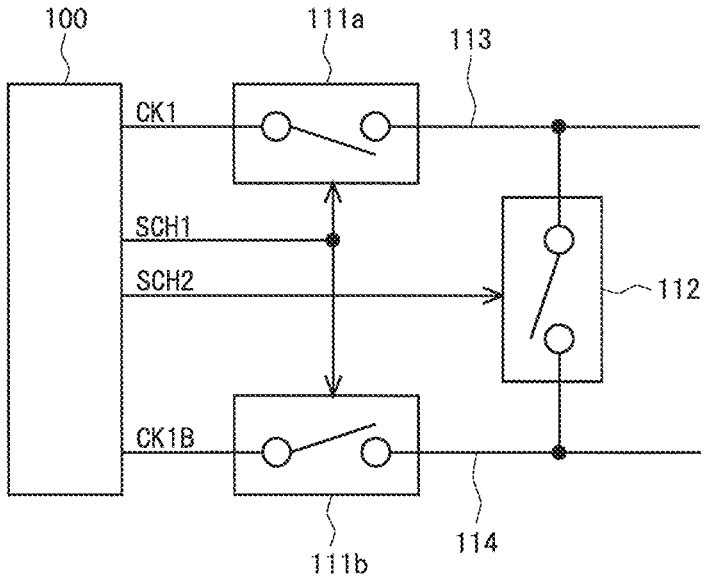
FIG. 8 is a diagram illustrating a configuration for performing charge sharing according to the embodiment.

FIG. 8 is a diagram illustrating a configuration for performing charge sharing. It should be noted that, here, a focus is given to charge sharing between a CK1 transmission line 113 and a CK1B transmission line 114. As components for performing charge sharing, a switch 111*a*, a switch 111*b*, and a switch 112 are provided on the control substrate B1. An on/off state of the switch 111*a* and the switch 111*b* is controlled by a charge sharing control signal SCH1, and an on/off state of the switch 112 is controlled by a charge sharing control signal SCH2. It should be noted that the charge sharing control signals SCH1 and SCH2 are outputted from the timing control circuit 100. Here, it is assumed that "each of the switches becomes the on state when the corresponding charge sharing control signal is at the high level, and becomes the off state when the corresponding charge sharing control signal is at the low level".

When a potential of the CK1 transmission line 113 (i. e., the gate clock signal CK1) is to change from the high level to the low level and when a potential of the CK1B transmission line 114 (i. e., the gate clock signal CK1B) is to change from the high level to the low level, the timing control circuit 100 turns the charge sharing control signal SCH1 to the low level and turns the charge sharing control signal SCH2 to the high level. With this, the switches 111*a* and 111*b* become the off state, and the switch 112 becomes the on state. As a result, the CK1 transmission line 113 and the CK1B transmission line 114 are short-circuited.

Other than the time when the potential of the CK1 transmission line 113 or the potential of the CK1B transmission line 114 is to change from the high level to the low level, the timing control circuit 100 maintains the charge sharing control signal SCH1 at the high level and maintains the charge sharing control signal SCH2 at the low level. With this, the switches 111*a* and 111*b* are maintained in the on state, and the switch 112 is maintained in the off state. Therefore, a direct power-supply voltage outputted as the gate clock signal CK1 from the timing control circuit 100 is applied to the CK1 transmission line 113, and a direct power-supply voltage outputted as the gate clock signal CK1B from the timing control circuit 100 is applied to the CK1B transmission line 114.

It should be noted that a short-circuit control unit is realized by the timing control circuit 100, the switch 111*a*, the switch 111*b*, and the switch 112 in this embodiment.

4. Layout of Signal Transmission Lines for Gate Control Signals and the Like

Figure 9:
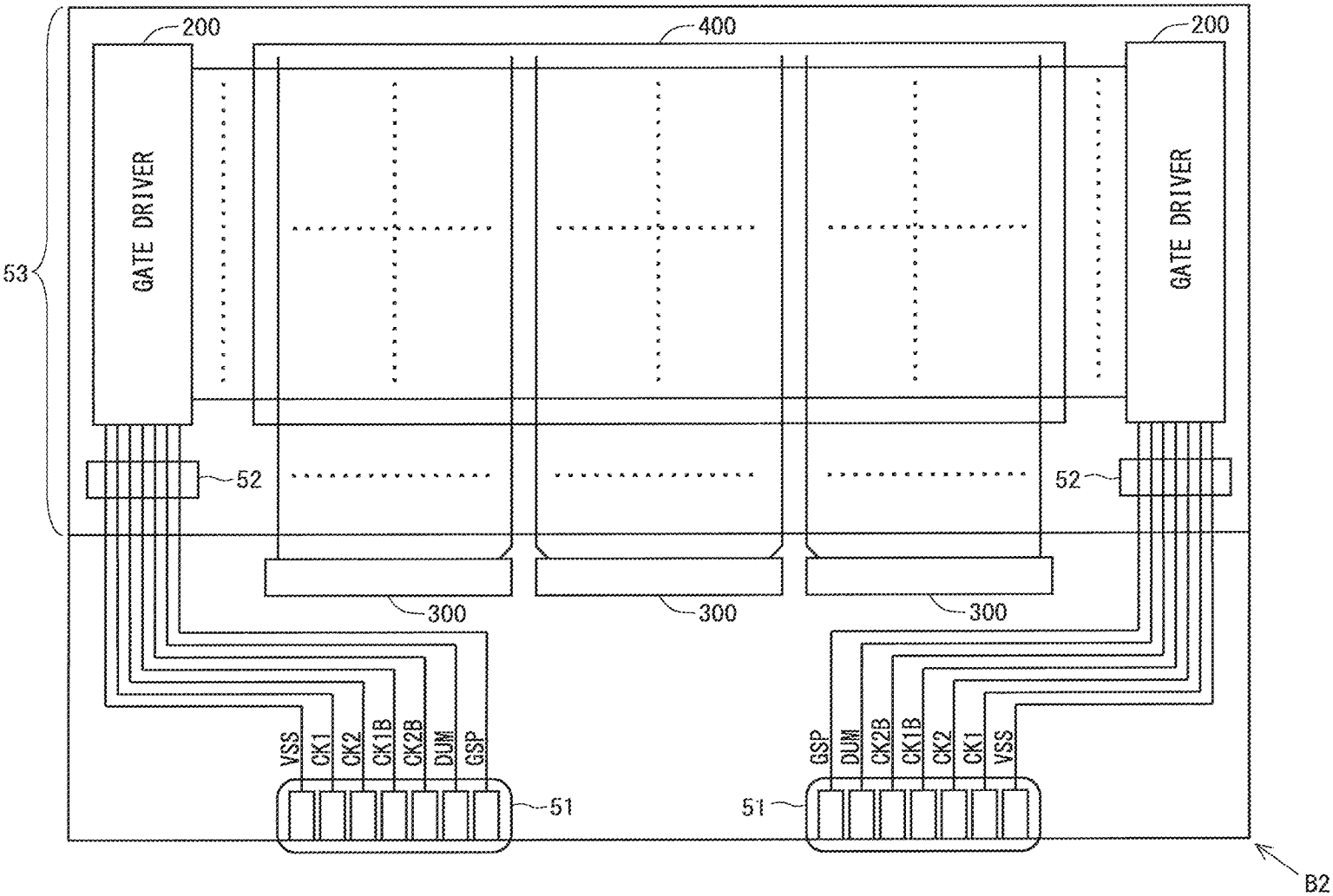
FIG. 9 is a diagram for illustration of a layout of signal transmission lines between a gate driver and a signal input terminal according to the embodiment.

Next, a layout of the signal transmission lines for gate control signals and the like in this embodiment will be described with reference to FIG. 9 and FIG. 10. Regarding FIG. 9, a portion indicated by a reference sign 53 is a region where the TFT substrate B2 and the color filter substrate face against each other. As shown in FIG. 9, a signal input terminal 51 for receiving a gate control signal and the like transmitted from the timing control circuit 100 is provided on the one end of the TFT substrate B2. In this embodiment, the gate control signal including the gate start pulse signal GSP and the gate clock signals CK1, CK1B, CK2, and CK2B as four-phase clock signals, the low-level direct power-supply voltage VSS, and a dummy signal DUM are supplied to the signal input terminal 51. It should be noted that, in the following description, a signal line for transmitting the dummy signal DUM is referred to as a "dummy signal transmission line".

Figure 16:
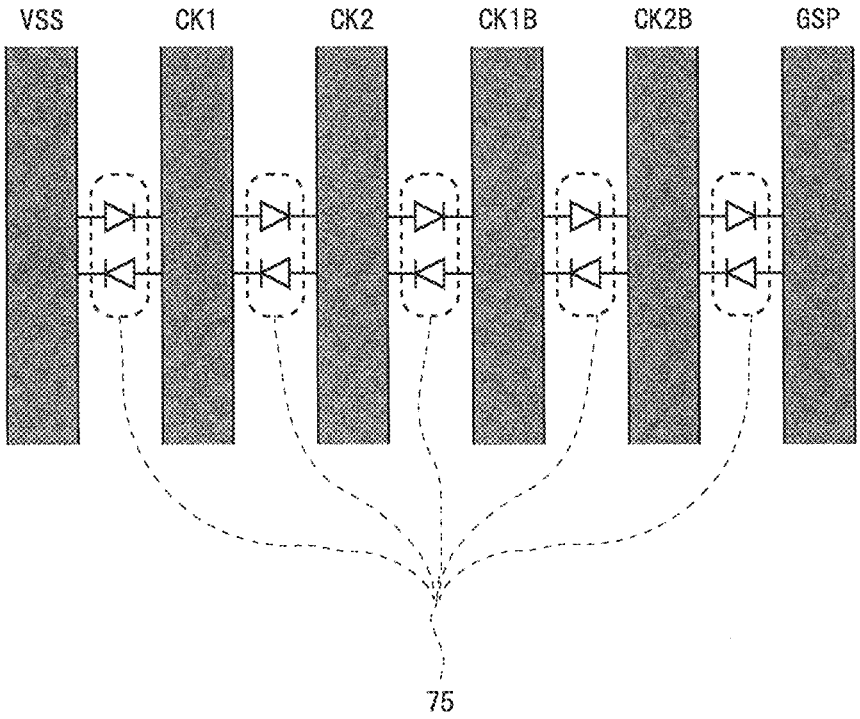
FIG. 16 is a schematic diagram illustrating a configuration of a protection circuit according to the conventional example.
Figure 17:
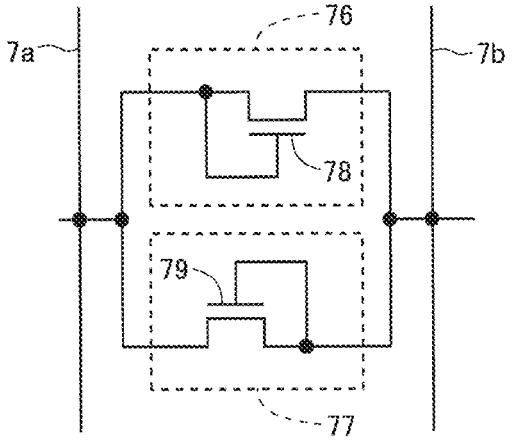
FIG. 17 is a circuit diagram illustrating a configuration of a diode ring according to the conventional example.
Figure 18:
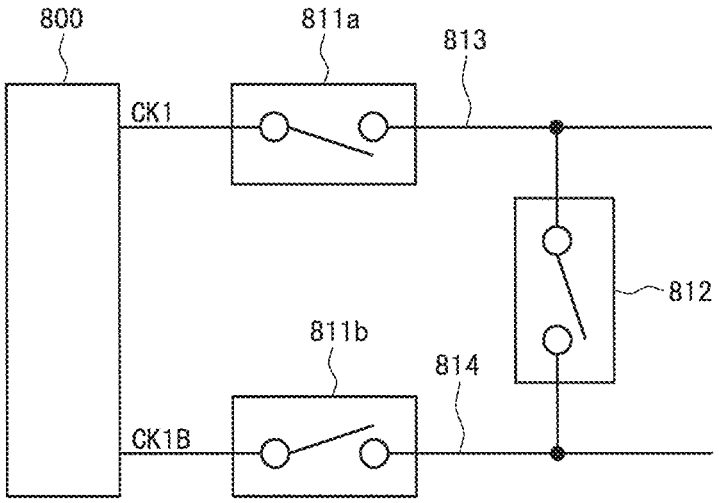
FIG. 18 is a diagram illustrating a schematic configuration for performing charge sharing according to the conventional example.
Figure 19:
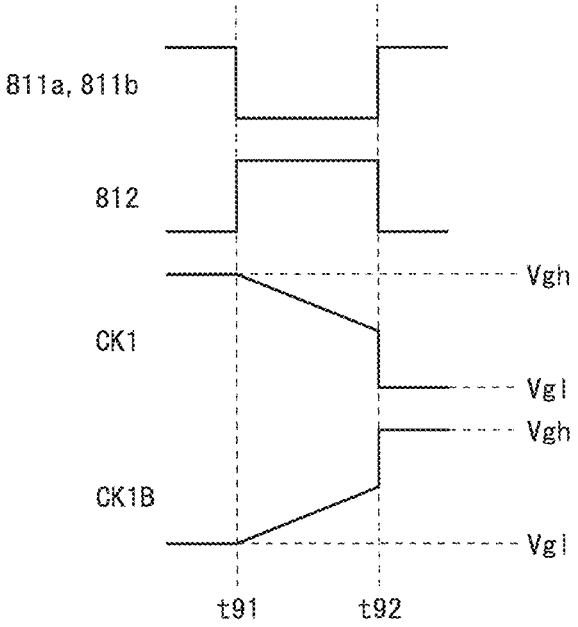
FIG. 19 is a signal waveform diagram for illustration of charge sharing according to the conventional example.
Figure 20:
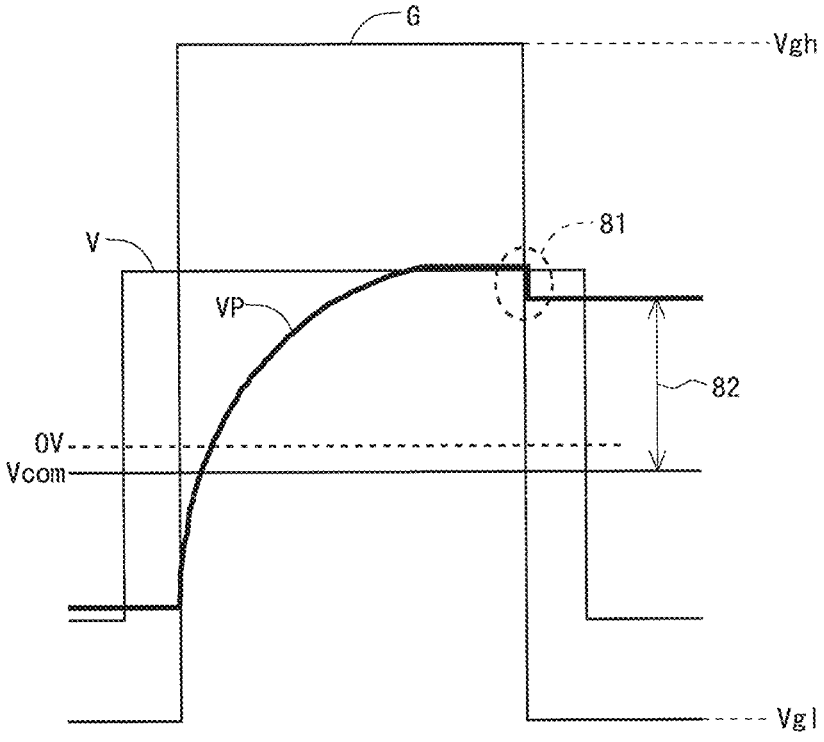
FIG. 20 is a signal waveform diagram when positive writing to a pixel capacitance is performed according to the conventional example.
Figure 21:
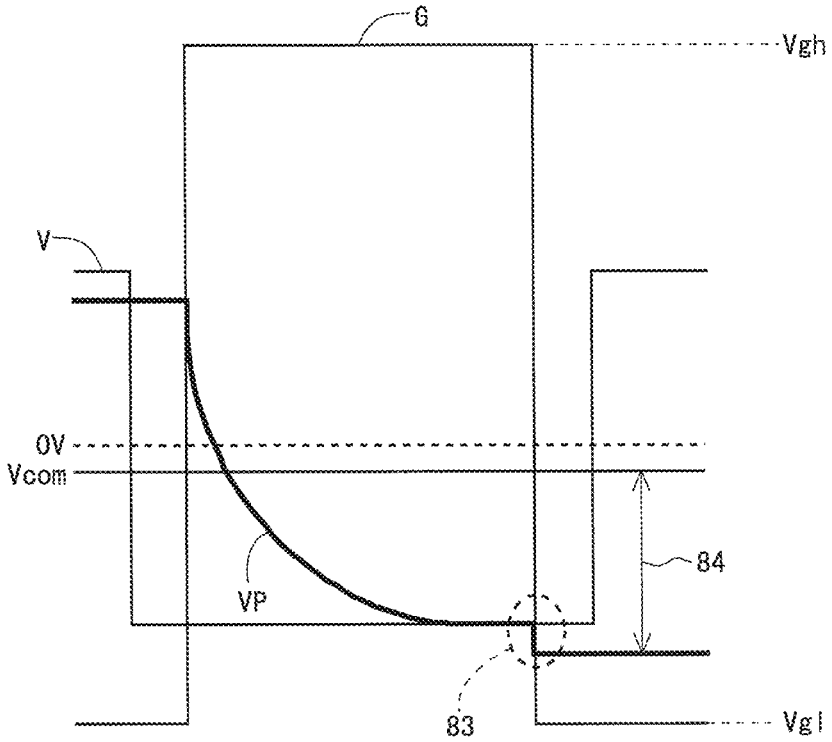
FIG. 21 is a signal waveform diagram when negative writing to the pixel capacitance is performed according to the conventional example.
Figure 22:
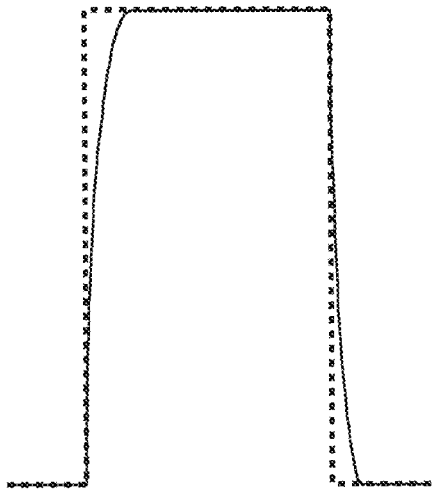
FIG. 22 is a diagram for illustration of a delay in a waveform of a scanning signal according to the conventional example.
Figure 23:
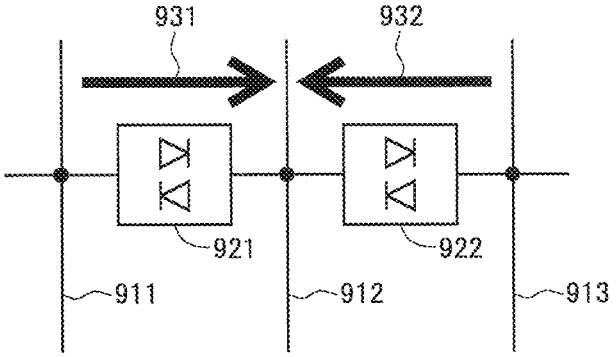
FIG. 23 is a diagram for illustration of a leak current between signal transmission lines via the diode ring according to the conventional example.
Figure 24:
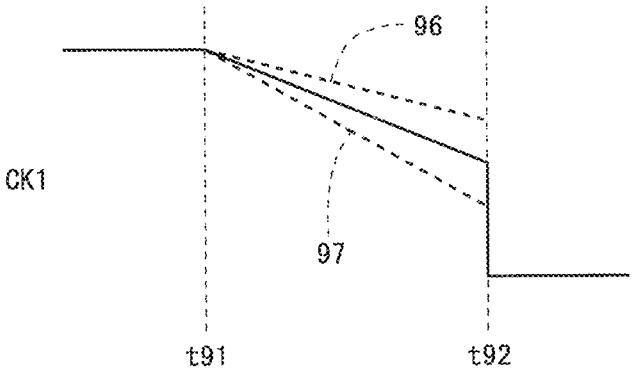
FIG. 24 is a diagram for illustration of an influence of the leak current between the signal transmission lines according to the conventional example.

Between the signal input terminal 51 and the gate driver 200, a protection circuit 52 for protecting circuit elements within the gate drivers 200 from static electricity is provided. As a specific configuration of the protection circuit 52 is the same as the conventional protection circuit 72 (see FIG. 16 and FIG. 17), a description shall be omitted.

Figure 10:
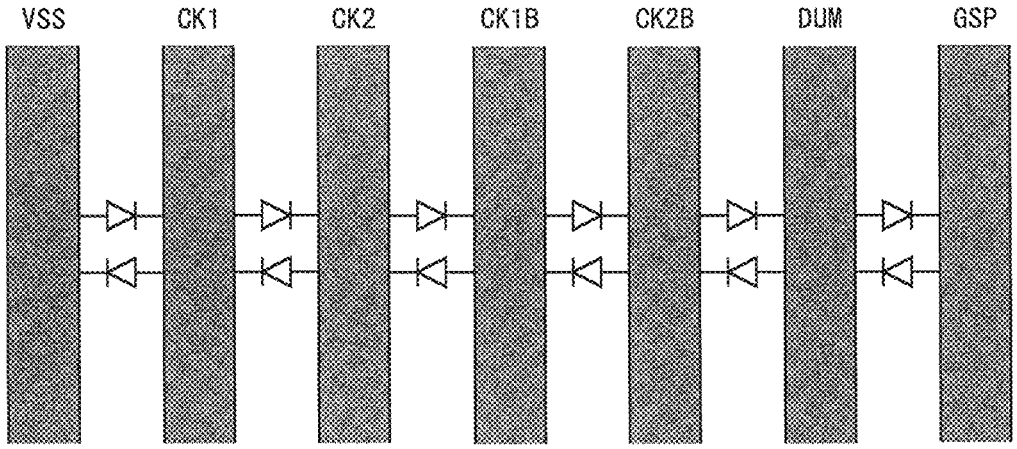
FIG. 10 is a diagram for illustration of the layout of the signal transmission lines according to the embodiment.

Between the signal input terminal 51 and the gate driver 200, the signal transmission lines are disposed on the TFT substrate B2 with a layout as shown in FIG. 10. Specifically, seven signal transmission lines are disposed on the TFT substrate B2 in an order of "the VSS transmission line, the CK1 transmission line, the CK2 transmission line, the CK1B transmission line, the CK2B transmission line, the dummy signal transmission line, and the GSP transmission line". As described above, in this embodiment, two gate clock signal transmission lines short-circuited by charge sharing described above are unadjacent to each other. It should be noted that to the dummy signal transmission line, the dummy signal DUM having a waveform that is the same as that of the gate clock signal CK1 is supplied from the timing control circuit 100.

Figure 11:
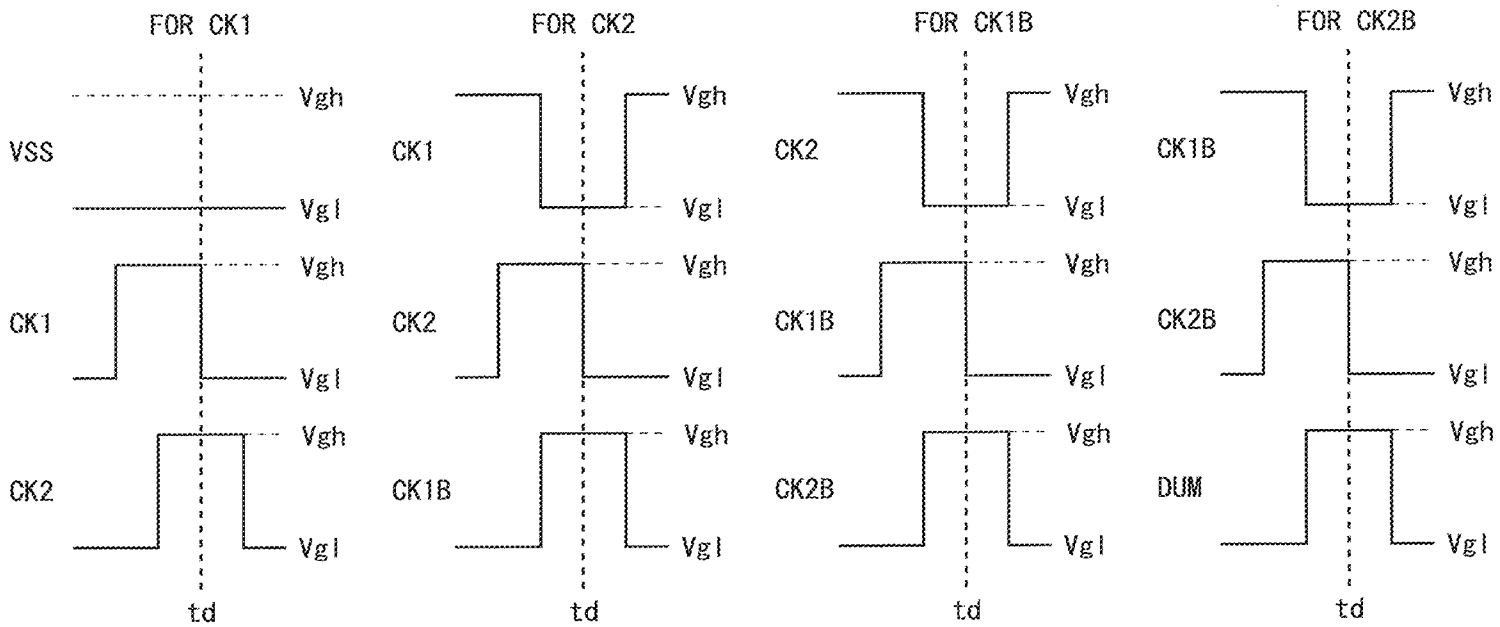
FIG. 11 is a diagram for illustration of changes in potentials of a first adjacent signal line and a second adjacent signal line before and after a potential of each of gate clock signal transmission lines changes from a high level to a low level, according to the embodiment.

In this embodiment, changes in the potentials of the first adjacent signal line and the second adjacent signal line before and after a time point when a potential of each of the gate clock signal transmission lines changes from the high level (the gate high potential Vgh) to the low level (the gate low potential Vgl) are as shown in FIG. 11.

In FIG. 11, a focus is given to the CK1 transmission line. At timing td at which the potential of the CK1 transmission line changes from the gate high potential Vgh to the gate low potential Vgl, a potential of the VSS transmission line as the first adjacent signal line is the gate low potential Vgl, and a potential of the CK2 transmission line as the second adjacent signal line is the gate high potential Vgh. In FIG. 11, a focus is given to the CK2 transmission line. At the timing td at which the potential of the CK2 transmission line changes from the gate high potential Vgh to the gate low potential Vgl, the potential of the CK1 transmission line as the first adjacent signal line is the gate low potential Vgl, and the potential of the CK1B transmission line as the second adjacent signal line is the gate high potential Vgh. In FIG. 11, a focus is given to the CK1B transmission line. At the timing td at which the potential of the CK1B transmission line changes from the gate high potential Vgh to the gate low potential Vgl, the potential of the CK2 transmission line as the first adjacent signal line is the gate low potential Vgl, and the potential of the CK2B transmission line as the second adjacent signal line is the gate high potential Vgh. In FIG. 11, a focus is given to the CK2B transmission line. At the timing td at which the potential of the CK2B transmission line changes from the gate high potential Vgh to the gate low potential Vgl, the potential of the CK1B transmission line as the first adjacent signal line is the gate low potential Vgl, and the potential of the dummy signal transmission line as the second adjacent signal line is the gate high potential Vgh.

Figure 26:
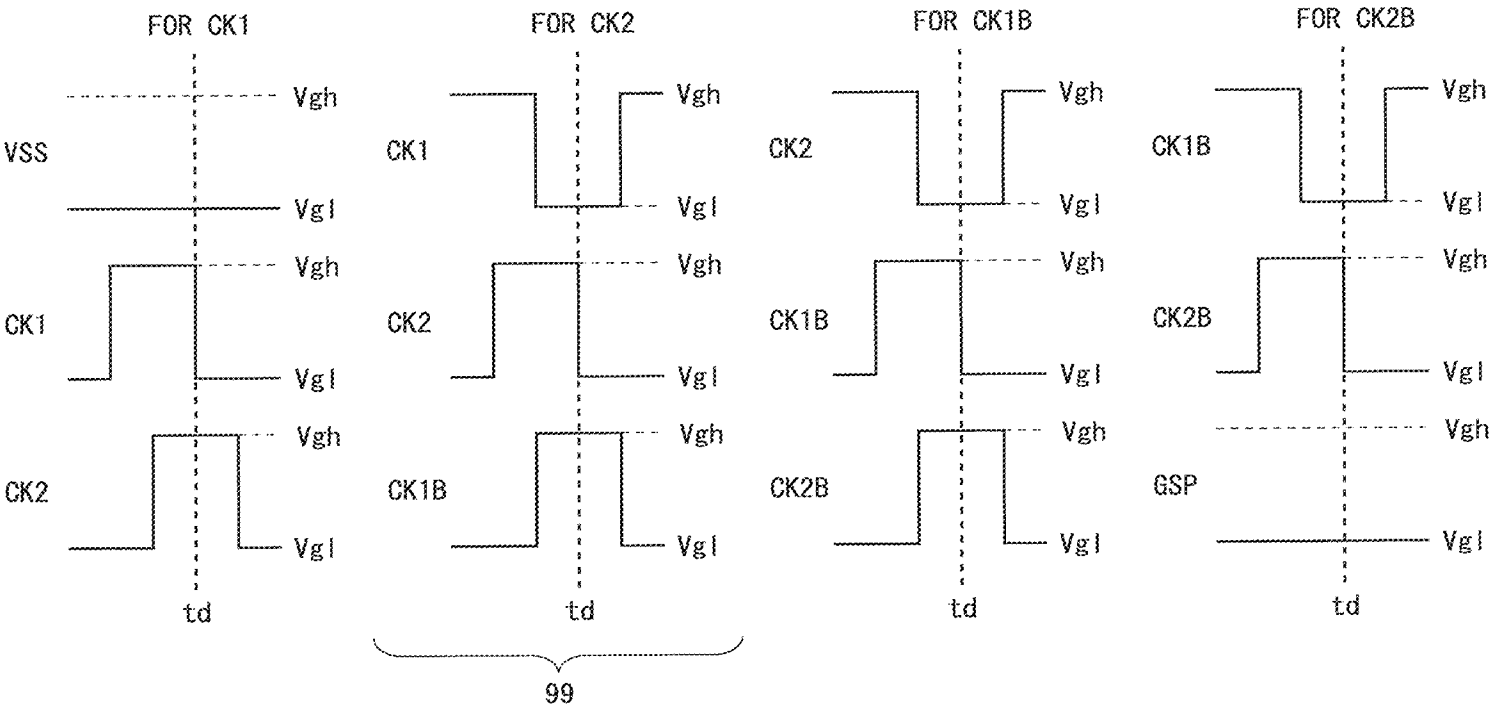
FIG. 26 is a diagram for illustration of changes in potentials of a first adjacent signal line and a second adjacent signal line before and after a potential of each of gate clock signal transmission lines changes from a high level to a low level, according to the conventional example.

As described above, unlike the conventional example (see FIG. 26), regarding any of the gate clock signal transmission lines, at the timing td at which the potential changes from the gate high potential Vgh to the gate low potential Vgl, the potential of the first adjacent signal line is the gate low potential Vgl, and the potential of the second adjacent signal line is the gate high potential Vgh. Thus, in this embodiment, the adjacent signal line state is the same for all of the gate clock signal transmission lines.

It should be noted that, in this embodiment, the scanning control clock signal transmission lines are realized by the gate clock signal transmission lines.

5. Effect

According this embodiment, in the liquid crystal display device having the gate drivers 200 monolithically provided on the TFT substrate B2, the gate clock signals CK1, CK1B, CK2, and CK2B as the four-phase clock signals are used in order to control the operation of the gate drivers 200. Between the signal input terminal 51 disposed on the one end of the TFT substrate B2 and the gate driver 200, the seven signal transmission lines including the four clock signal transmission lines respectively transmitting the gate clock signals CK1, CK1B, CK2, and CK2B are disposed. In this configuration, the seven signal transmission lines are disposed so that the adjacent signal line state for all of the four clock signal transmission lines becomes the same. Accordingly, a leak current is occurred in the same manner when charge sharing is performed, regardless of the clock signal transmission line subjected to charge sharing. Therefore, a signal waveform when the signal potential changes from the high level (the gate high potential Vgh) to the low level (the gate low potential Vgl) becomes similar for all of the gate clock signals CK1, CK1B, CK2, and CK2B. With this, a magnitude of the pull-in voltage due to a falling edge of the scanning signal becomes almost similar for all of the lines. As a result, occurrence of horizontal stripes on a screen is suppressed. As described above, according to this embodiment, in the liquid crystal display device having a monolithic gate driver, occurrence of horizontal stripes due to a leak current between the signal transmission lines is suppressed.

6. Modified Example

Hereinafter, modified examples of the above-described embodiment will be described.

6.1 First Modified Example

Figure 12:
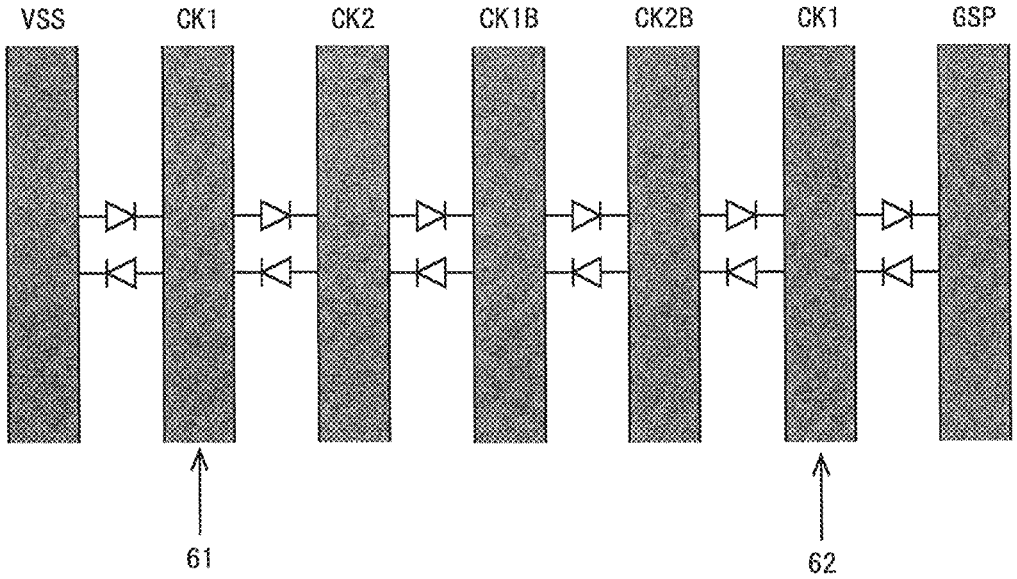
FIG. 12 is a diagram for illustration of a layout of signal transmission lines according to a first modified example of the embodiment.

According to the above-described embodiment, regarding the CK2B transmission line, the first adjacent signal line is the CK1B transmission line, and the second adjacent signal line is the dummy signal transmission line. However, the configuration may be such that a CK1 transmission line indicated by a reference sign 61 in FIG. 12 is disposed between the CK2B transmission line and the GSP transmission line as indicated by reference sign 62 in FIG. 12 by leading the CK1 transmission line within the liquid crystal panel. Also by such a configuration, the adjacent signal line state for all of the four gate clock signal transmission lines becomes the same as shown in FIG. 11. Therefore, the same effect as the above-described embodiment may be obtained.

6.2 Second Modified Example

Figure 13:
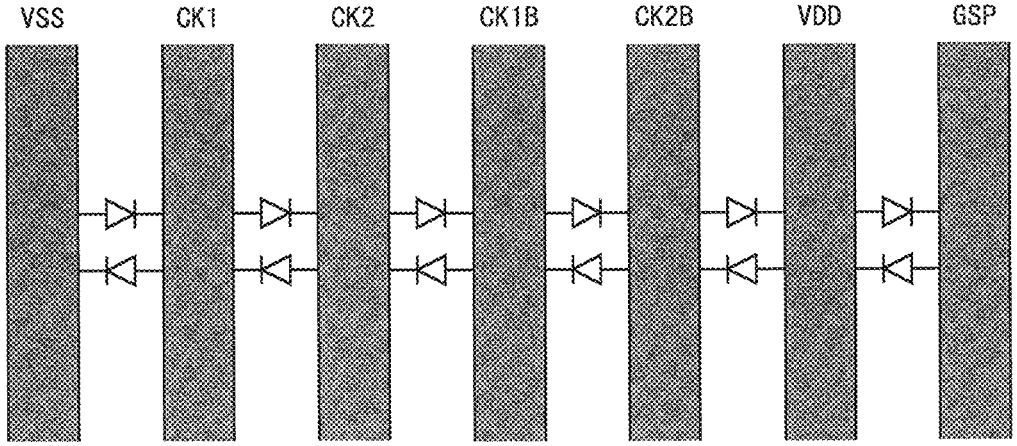
FIG. 13 is a diagram for illustration of a layout of signal transmission lines according to a second modified example of the embodiment.

FIG. 13 is a diagram for illustration of a layout of the signal transmission lines according to second modified example of the above-described embodiment. As can be seen from FIG. 13, in this modified example, a VDD transmission line (high voltage signal transmission line) as a signal line for transmitting a high-level direct power-supply voltage VDD is disposed between the CK2B transmission line and the GSP transmission line.

Figure 14:
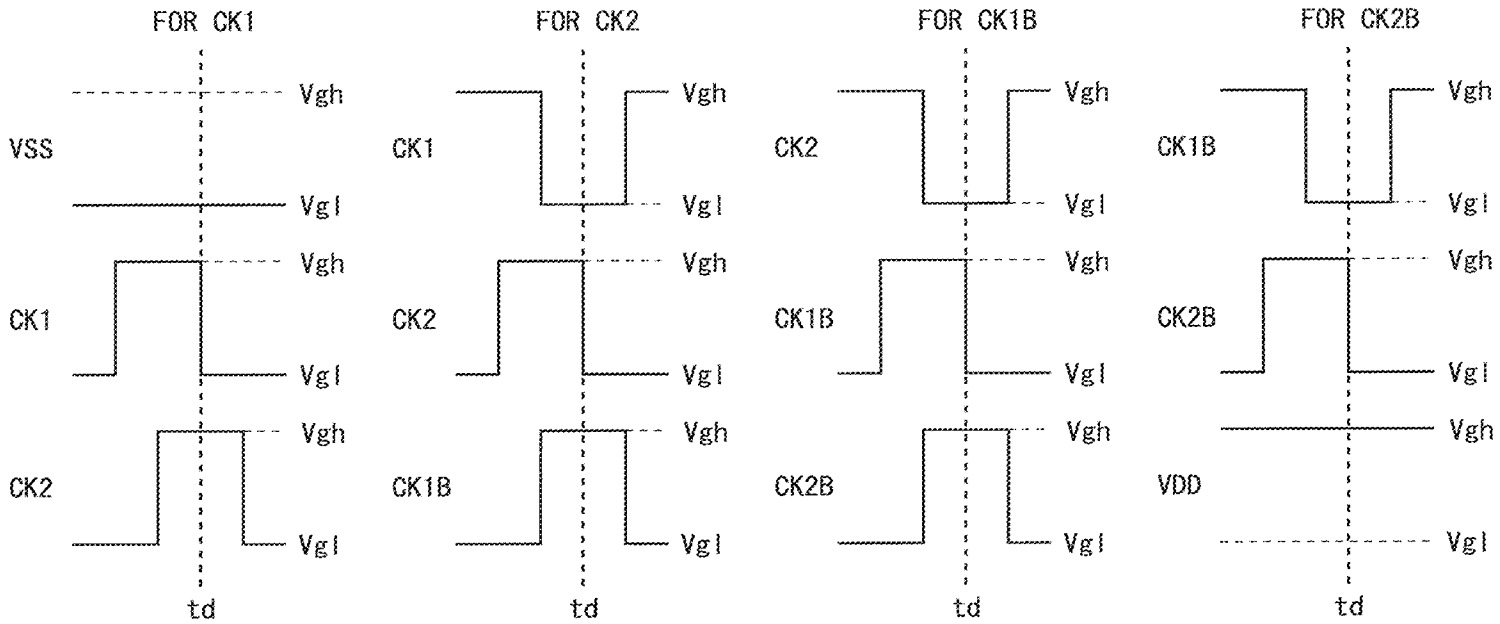
FIG. 14 is a diagram for illustration of changes in potentials of a first adjacent signal line and a second adjacent signal line before and after a potential of each of gate clock signal transmission lines changes from a high level to a low level, according to the second modified example of the embodiment.
Figure 15:
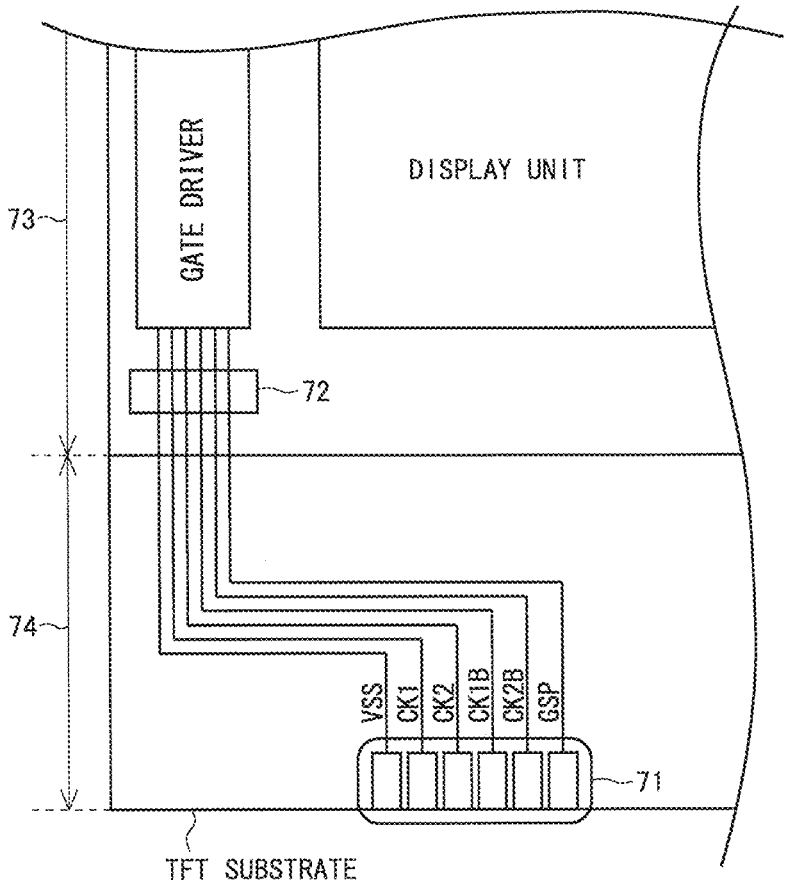
FIG. 15 is a diagram for illustration of a layout of signal transmission lines between a gate driver and a signal input terminal according to a conventional example.

According to this modified example, changes in the potentials of the first adjacent signal line and the second adjacent signal line before and after a time point when a potential of each of the gate clock signal transmission lines changes from the high level (the gate high potential Vgh) to the low level (the gate low potential Vgl) are as shown in FIG. 14. In FIG. 14, a focus is given to the CK2B transmission line. At the timing td at which the potential of the CK2B transmission line changes from the gate high potential Vgh to the gate low potential Vgl, the potential of the CK1B transmission line as the first adjacent signal line is the gate low potential Vgl, and the potential of the VDD transmission line as the second adjacent signal line is the gate high potential Vgh. Regarding the CK1 transmission line, the CK1B transmission line, and the CK2 transmission line, they are the same as in the above-described embodiment. From the above, regarding any of the gate clock signal transmission lines, at the timing td at which the potential changes from the gate high potential Vgh to the gate low potential Vgl, the potential of the first adjacent signal line is the gate low potential Vgl, and the potential of the second adjacent signal line is the gate high potential Vgh. In this manner, the adjacent signal line state for all of the gate clock signal transmission lines becomes the same. Therefore, this modified example also provides the same effect as the above-described embodiment.

7. Others

Although description is given taking the liquid crystal display device as an example in the above-described embodiment, the present invention is not limited to this example. The present invention may be applied to any display device other than the liquid crystal display device as long as the display device has the monolithic gate driver. For example, the present invention may be applied to a display device that is called an electronic paper (microencapsulated electrophoretic display device) or an organic EL display device.

In the above, although the present invention has been described in detail, the above description is merely exemplary in every aspect, and not limiting. It is understood that various other alterations and modifications can be made without departing from the scope of the present invention.

What is claimed is:

1. A display device having a display panel including a display unit on which a plurality of scanning signal lines are disposed, the display device comprising:

a scanning signal line drive circuit configured to drive the plurality of scanning signal lines, the scanning signal line drive circuit being formed in a monolithic manner on a panel substrate that constitutes the display panel; and a signal input terminal disposed on the panel substrate, the signal input terminal receiving at least a plurality of scanning control signals for controlling an operation of the scanning signal line drive circuit, wherein the plurality of scanning control signals include a plurality of scanning control clock signals that are clock signals having four or more phases, a plurality of signal transmission lines are disposed between the signal input terminal and the scanning signal line drive circuit, the plurality of signal transmission lines including a plurality of scanning control clock signal transmission lines respectively transmitting the plurality of scanning control clock signals, regarding any scanning control clock signal transmission line, assuming that two signal transmission lines that are adjacent to a focused scanning control clock signal transmission line are defined as a first adjacent signal line and a second adjacent signal line, and assuming that a combination of a potential of the first adjacent signal line and a potential of the second adjacent signal line when a potential of the focused scanning control clock signal transmission line changes from a high level to a low level is defined as an adjacent signal line state, the adjacent signal line state is identical for all of the plurality of scanning control clock signal transmission lines, the display device further includes a short-circuit control unit for causing two scanning control clock signal transmission lines to be short-circuited to each other, to any scanning control clock signal transmission line, a cathode of a diode whose anode is connected to the first adjacent signal line, an anode of a diode whose cathode is connected to the first adjacent signal line, a cathode of a diode whose anode is connected to the second adjacent signal line, and an anode of a diode whose cathode is connected to the second adjacent signal line are connected, the plurality of scanning control clock signal transmission lines are divided into groups each including two scanning control clock signal transmission lines respectively transmitting two scanning control clock signals whose phases are displaced by 180 degrees, and when the potential of any scanning control clock signal transmission line is to change from the high level to the low level, the short-circuit control unit causes one pair of two scanning control clock signal transmission lines including the focused scanning control clock signal transmission line to be short-circuited.

2. The display device according to claim 1, wherein the adjacent signal line state is identical for all of the plurality of scanning control clock signal transmission lines by providing a dummy signal transmission line adjacent to any of the plurality of scanning control clock signal transmission lines.

3. The display device according to claim 2, wherein the dummy signal transmission line transmits a dummy signal different from the plurality of scanning control signals, and the signal input terminal includes a terminal to which the dummy signal is inputted from outside of the display panel.

4. The display device according to claim 2, wherein one of the plurality of scanning control signals is supplied to the dummy signal transmission line, by leading a corresponding signal transmission line over the panel substrate.

5. The display device according to claim 1, wherein the adjacent signal line state is identical for all of the plurality of scanning control clock signal transmission lines by providing a high voltage signal transmission line adjacent to any of the plurality of scanning control clock signal transmission lines, the high voltage signal transmission line transmitting a high-level voltage.

6. The display device according to claim 1, wherein regarding any scanning control clock signal transmission line, when the potential of the focused scanning control clock signal transmission line changes from the high level to the low level, the potential of one of the first adjacent signal line and the second adjacent signal line is maintained at the high level, and the potential of the other of the first adjacent signal line and the second adjacent signal line is maintained at the low level.

7. The display device according to claim 1, wherein two scanning control clock signal transmission lines that are short-circuited by the short-circuit control unit are unadjacent.

* * * * *